US010980290B2

(12) United States Patent
Sasaki

(10) Patent No.: US 10,980,290 B2
(45) Date of Patent: Apr. 20, 2021

(54) GARMENT

(71) Applicant: Beji Sasaki, Tokyo (JP)

(72) Inventor: Beji Sasaki, Tokyo (JP)

( * ) Notice: Subject to any disclaimer, the term of this patent is extended or adjusted under 35 U.S.C. 154(b) by 238 days.

(21) Appl. No.: 16/087,073

(22) PCT Filed: Sep. 19, 2017

(86) PCT No.: PCT/JP2017/033634
§ 371 (c)(1),
(2) Date: Sep. 20, 2018

(87) PCT Pub. No.: WO2019/058411
PCT Pub. Date: Mar. 28, 2019

(65) Prior Publication Data

US 2020/0323282 A1 Oct. 15, 2020

(51) Int. Cl.
*A41D 1/22* (2018.01)
*A41D 10/00* (2006.01)
*A41D 13/12* (2006.01)

(52) U.S. Cl.
CPC ..... *A41D 1/22* (2013.01); *A41D 10/00* (2013.01); *A41D 13/12* (2013.01); *A41D 13/1209* (2013.01); *A41D 13/1263* (2013.01)

(58) Field of Classification Search
CPC .. A41D 1/22; A41D 13/1209; A41D 13/1263; A41D 13/12; A41D 10/00
See application file for complete search history.

(56) References Cited

U.S. PATENT DOCUMENTS

2015/0157064 A1* 6/2015 Inoue ..... A41D 1/22 2/74

FOREIGN PATENT DOCUMENTS

| | | | |
|---|---|---|---|
| JP | S4932805 | U | 3/1974 |
| JP | S 62114008 | U | 7/1987 |
| JP | H 01074212 | U | 5/1989 |
| JP | H 05089409 | U | 12/1993 |
| JP | H0719308 | U | 4/1995 |
| JP | 2001159006 | A | 6/2001 |
| JP | 2013053382 | A | 3/2013 |

OTHER PUBLICATIONS 1860-1960.com, Japanese Geisha Silk Screen,1860-1960 fashion, 6 pages (Year: 2012).*
International Search Report for PCT/JP2017/033634 dated Oct. 31, 2017. Translation from Google Translate.
Extended European Search Report from EP app. No. 17901329.7, dated Mar. 9, 2021.

* cited by examiner

*Primary Examiner* — Khaled Annis
(74) *Attorney, Agent, or Firm* — Ladas & Parry, LLP

(57) ABSTRACT

A garment has a main body part 20 having a pair of collar parts 10 and a waistline part 40 positioned below the collar parts 10, two swinging sleeve parts 30 coupled to the main body part 20 and an obi part 100 wound around the waistline part 40. One of the collar parts 10 is fixed to the other. The swinging sleeve part 30 has a plurality of swinging sleeve convex-concave parts 35 extending in a direction perpendicular to a direction from a root 30*a* to a sleeve opening 30*b*.

6 Claims, 15 Drawing Sheets

GARMENT

CROSS-REFERENCE TO RELATED APPLICATIONS

The present application is the U.S. national phase of PCT Application PCT/JP2017/033634 filed on Sep. 19, 2017 of which is incorporated herein by reference in its entirety.

TECHNICAL FIELD

The present invention relates to a garment having a swinging sleeve part coupled to a main body part and an obi part wound on a waistline part of the main body part.

BACKGROUND ART

Regarding conventionally known Japanese clothing, inventions have been proposed, for example, from the viewpoint of dressing beautifully. For example, Patent Literature 1 describes the problem that it is difficult to make an ohashori fold and, for this reason, many people hesitate to wear Japanese clothing. Patent Literature 1 proposes forming a pseudo-ohashori obi that looks like ohashori as a separate body from the main body of Japanese clothing.

In addition, Patent Literature 2 describes an improvement of Patent Literature 1 in which ohashori can easily be formed (presented by a pseudo-ohashori obi), the right and left hems can easily be narrowed inward, and the hem of the right-hand shitamae-okumi, which is a lower layer, is set to be higher than the hem of the left-hand uwamae-okumi, which is an upper layer.

CITATION LIST

Patent Literature

Patent Literature 1: JP 2001-159006 A
Patent Literature 2: JP 2013-53382 A

SUMMARY OF INVENTION

Technical Problem

The present invention does not relate to conventional Japanese clothing itself, but provides a garment that is made of a concept entirely different from the conventional Japanese clothing and that looks like Japanese clothing.

Solution to Problem

A garment according to the present invention may comprise a main body part having a pair of collar parts and a waistline part positioned below the collar parts;

two swinging sleeve parts coupled to the main body part and an obi part wound around the waistline part, wherein one of the collar parts may be fixed to the other and the swinging sleeve part may have a plurality of swinging sleeve convex-concave parts extending in a direction perpendicular to a direction, from a root to a sleeve opening.

In the garment according to the present invention, the main body part may have a plurality of main body convex-concave parts extending in an up-and-down direction.

In the garment according to the present invention, the collar part may have a first collar fabric, a second collar fabric provided on the first collar fabric, and a third collar fabric provided on the second collar fabric, and the first collar fabric, the second collar fabric and the third collar fabric may be not provided with a convex-concave part.

In the garment according to the present invention, the obi part may have an obi strap part, which includes a first obi strap part and a pair of second obi strap parts extended from the first obi strap part, and an obi tying part, which is a separate body from the obi strap part and which can cover the first obi strap part, and a passage hole, through which the second obi strap part is placed, may be formed in the first obi strap part.

The garment, according to the present invention, may further comprise a thick paper part provided in the first obi strap part, wherein the thick paper part may have a first thick paper part provided at a portion to be covered by the obi tying part, and a second thick paper part provided at both ends of the first obi strap part.

ADVANTAGEOUS EFFECTS OF INVENTION

According to the present invention, since the aspect that has the swinging sleeve parts and the obi part and in which one of the collar parts is fixed to the other is adopted, the garment looks like Japanese clothing and enables easy wearing of the garment. Further, since the aspect in which the swinging sleeve parts have the plurality of swinging sleeve convex-concave parts extending in the direction perpendicular to the direction from the root to the sleeve opening is adopted, the shape of the swinging sleeve parts can easily be maintained and can give a Japanese clothing-like impression.

DESCRIPTION OF EMBODIMENTS

Figure 1:
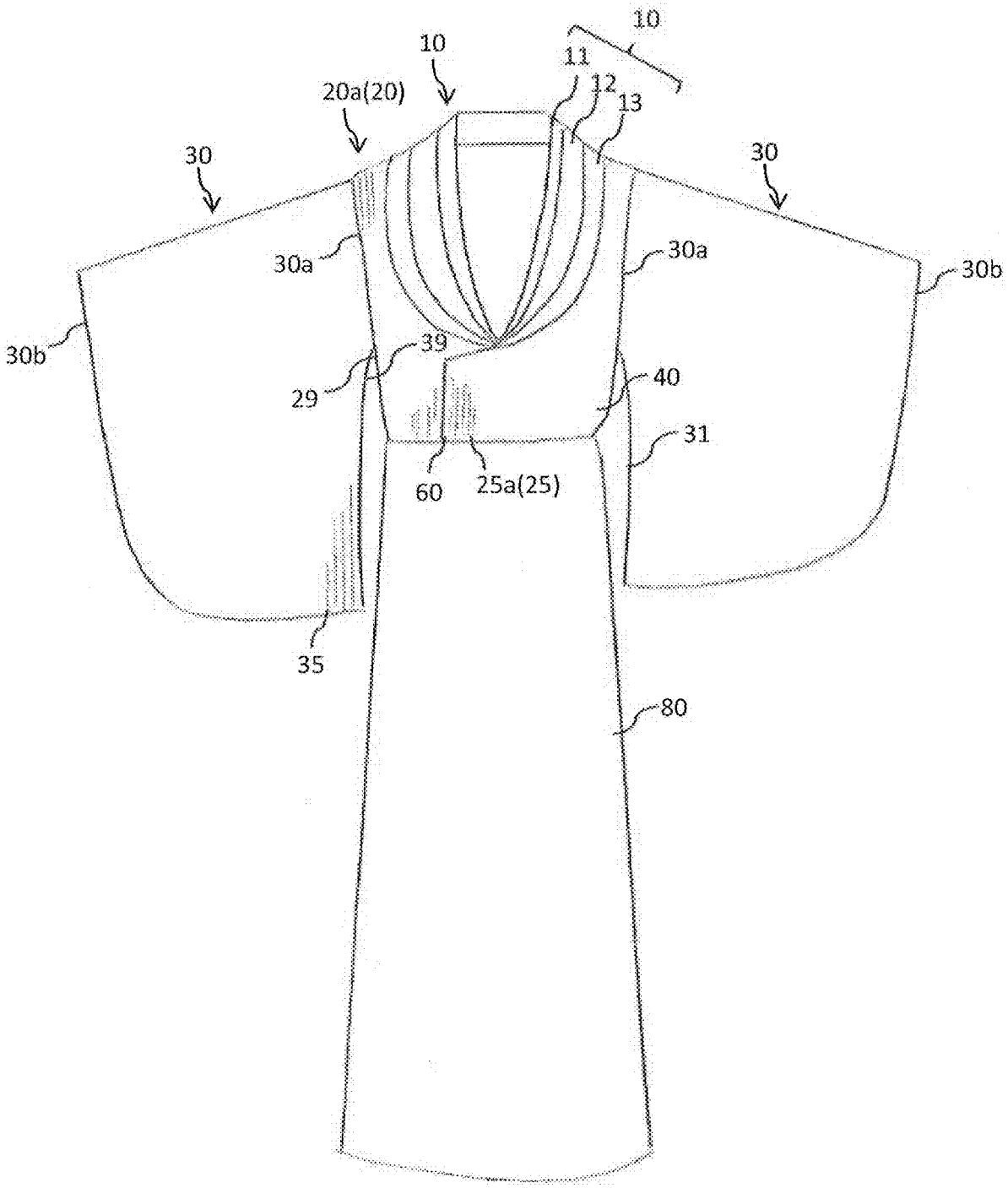
FIG. 1 is a front view illustrating an upper wear of a garment according to an example used in an embodiment of the present invention.
Figure 2:
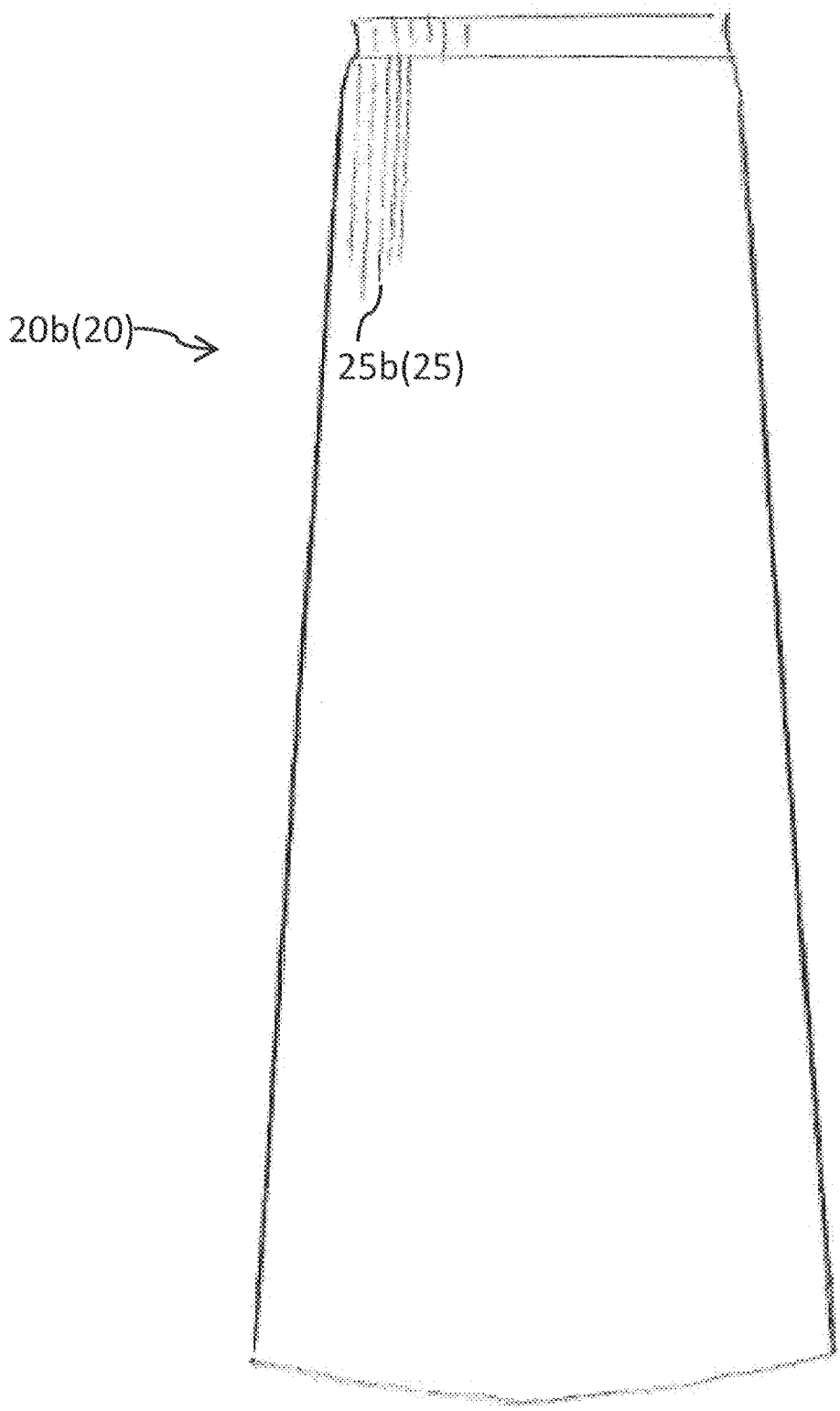
FIG. 2 is a front view illustrating a lower wear of a garment according to an example used in an embodiment of the present invention.

The garment according to the present embodiment may be a two-piece having an upper wear and a lower wear provided below the upper wear as illustrated in FIGS. 1 and 2. However, the garment is not limited to such an aspect, but may be a one-piece as illustrated in FIG. 3.

Figure 3:
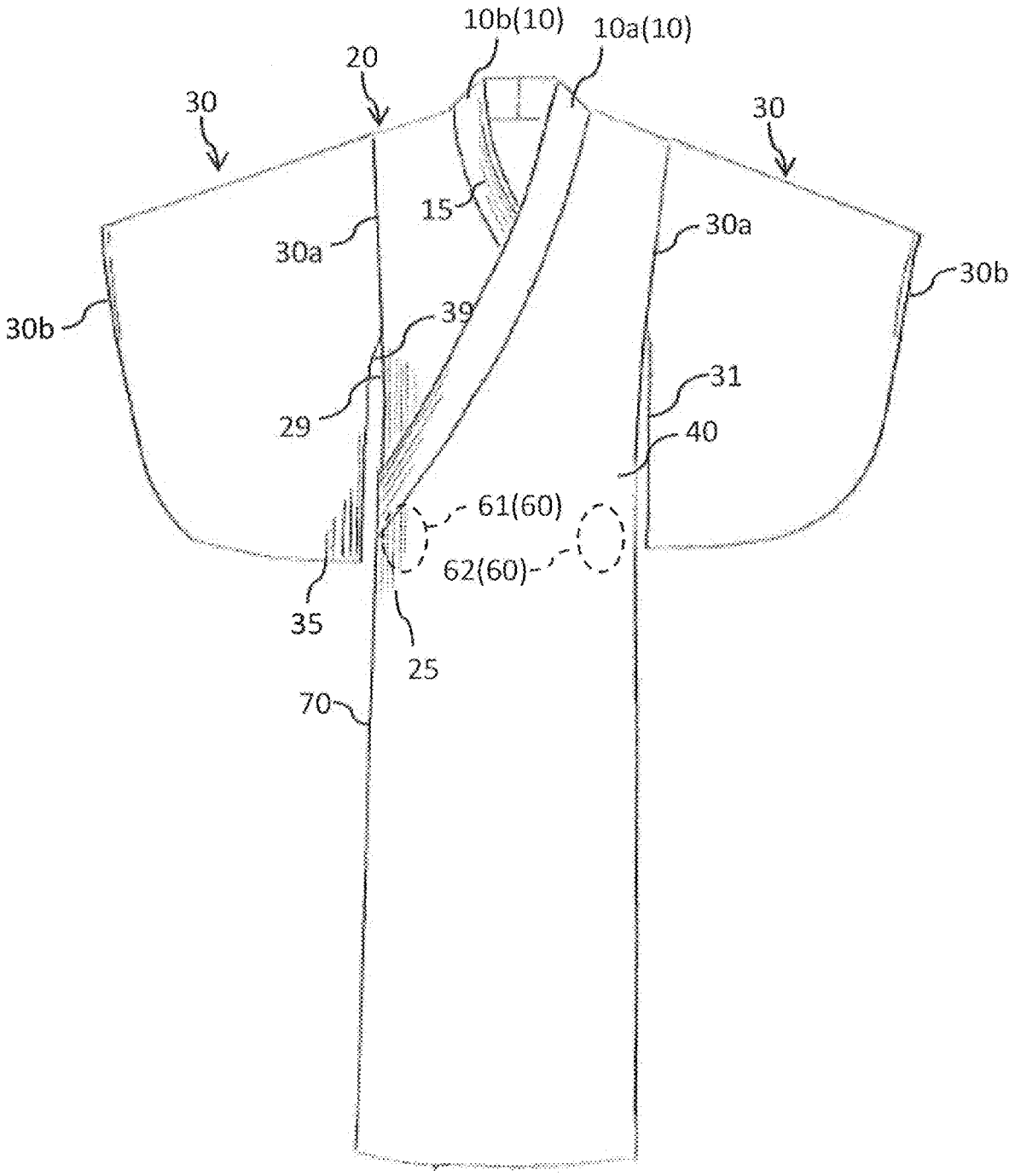
FIG. 3 is a front view illustrating a garment according to Variation 1 used in an embodiment of the present invention.
Figure 10:
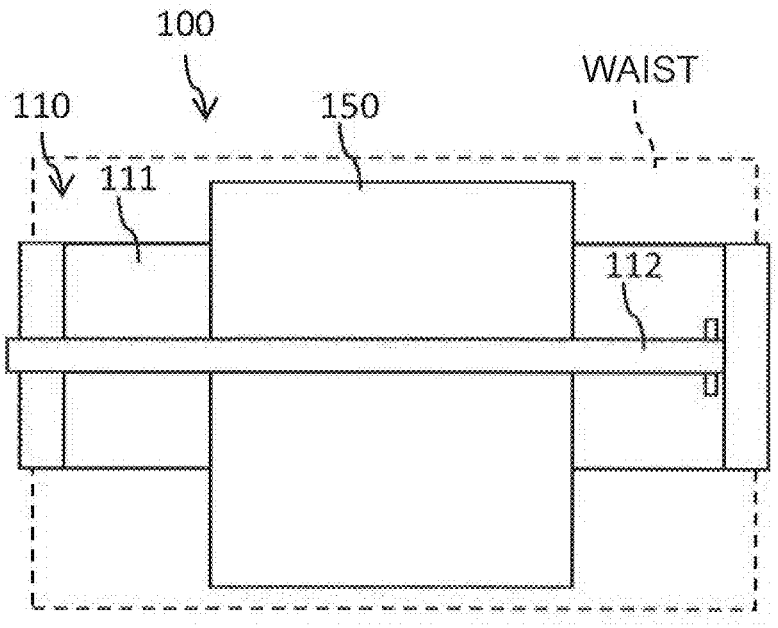
FIG. 10 is a view illustrating an aspect in which a second obi strap part on the right side in the state of FIG. 9 is wound around the waist of the wearer.
Figure 13:
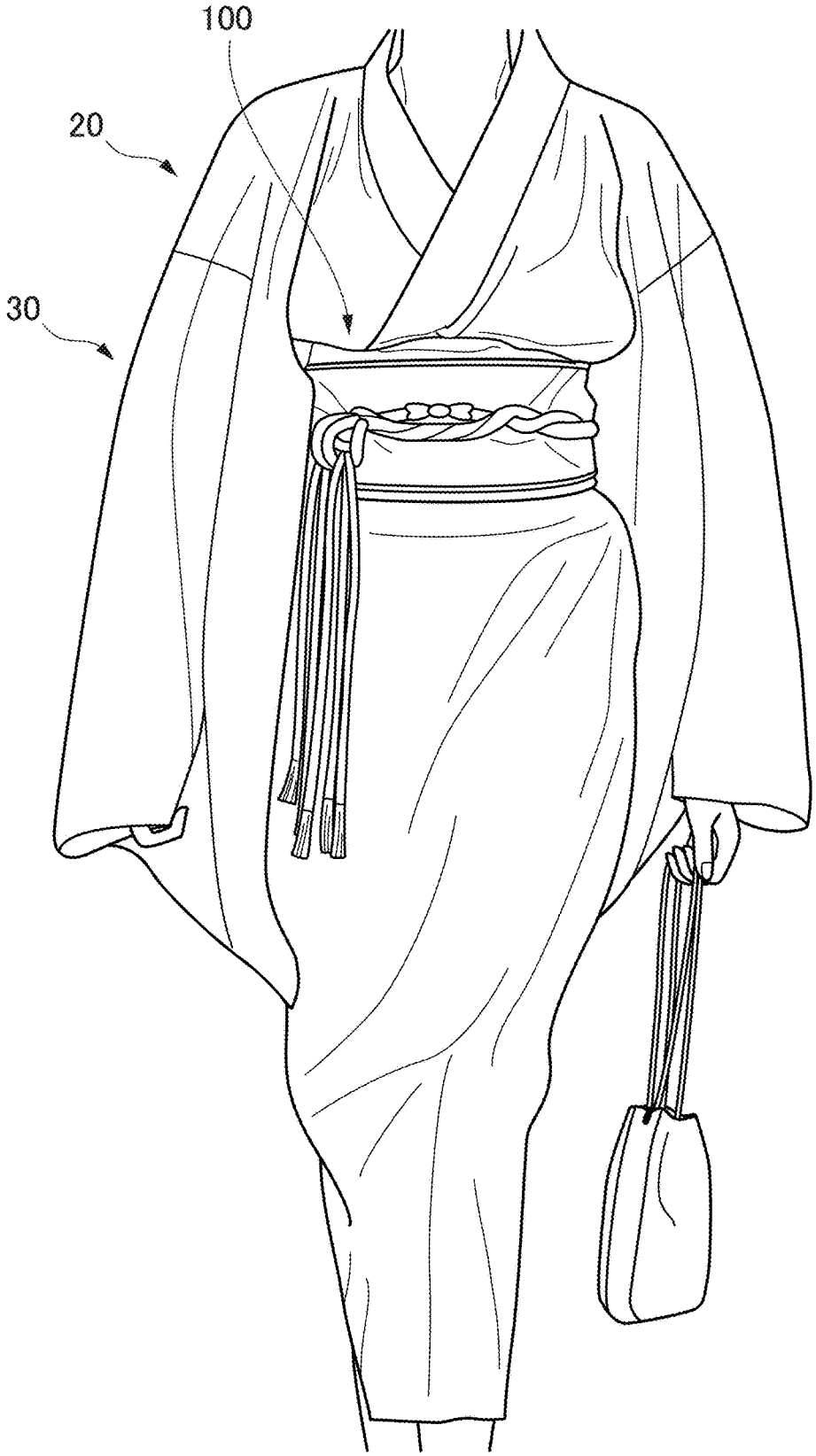
FIG. 13 is a photograph illustrating a state in which a garment that can be used in an embodiment of the present invention is worn.

As illustrated in FIGS. 1 and 3, the garment of the present embodiment may have a pair of collar parts 10, a main body part 20 having a waistline part 40 positioned below the collar parts 10 (positioned at the waist of a wearer), and two swinging sleeve parts 30 coupled to the main body part 20. As illustrated in FIG. 10, the garment may have an obi part 100 wound around the waistline of the wearer, i.e., the waistline part 40 of the main body part 20 (see also FIG. 13). In the present embodiment, the waistline part 40 indicates a part covered by the obi part 100. As a material of the main body part 20 and the swinging sleeve parts 30, polyester may be used as the main material. Herein, the main material indicates that a material is used in an amount of 50% by weight or more. In addition, the main body part 20 and the swinging sleeve parts 30 may be formed solely of polyester.

As illustrated in FIGS. 1 and 3, the end of each of the pair of swinging sleeve parts 30 facing the main body part 20 may be provided with a swinging sleeve opening part 39. In addition, each of the ends of the main body part 20 facing the swinging sleeve parts 30 may be provided with a main body opening part 29. The ends of the pair of swinging sleeve parts 30 facing the main body part 20 may have a straight extension part 31, which extends in an up-and-down direction when the swinging sleeve parts 30 are spread out as illustrated in FIGS. 1 and 3.

Figure 11:
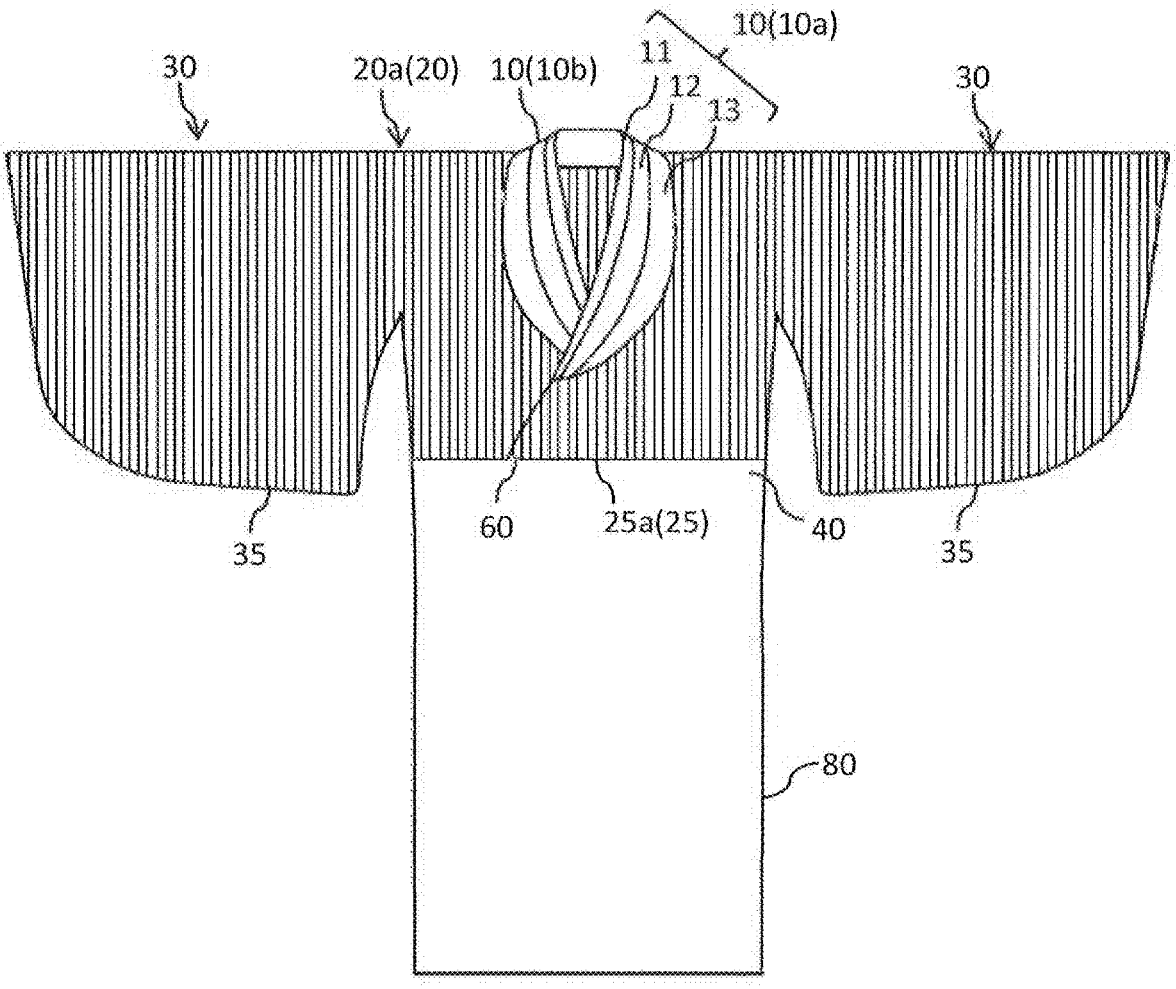
FIG. 11 is a front view illustrating an upper wear side of a garment according to Variation 2 that can be used in an embodiment of the present invention.
Figure 12:
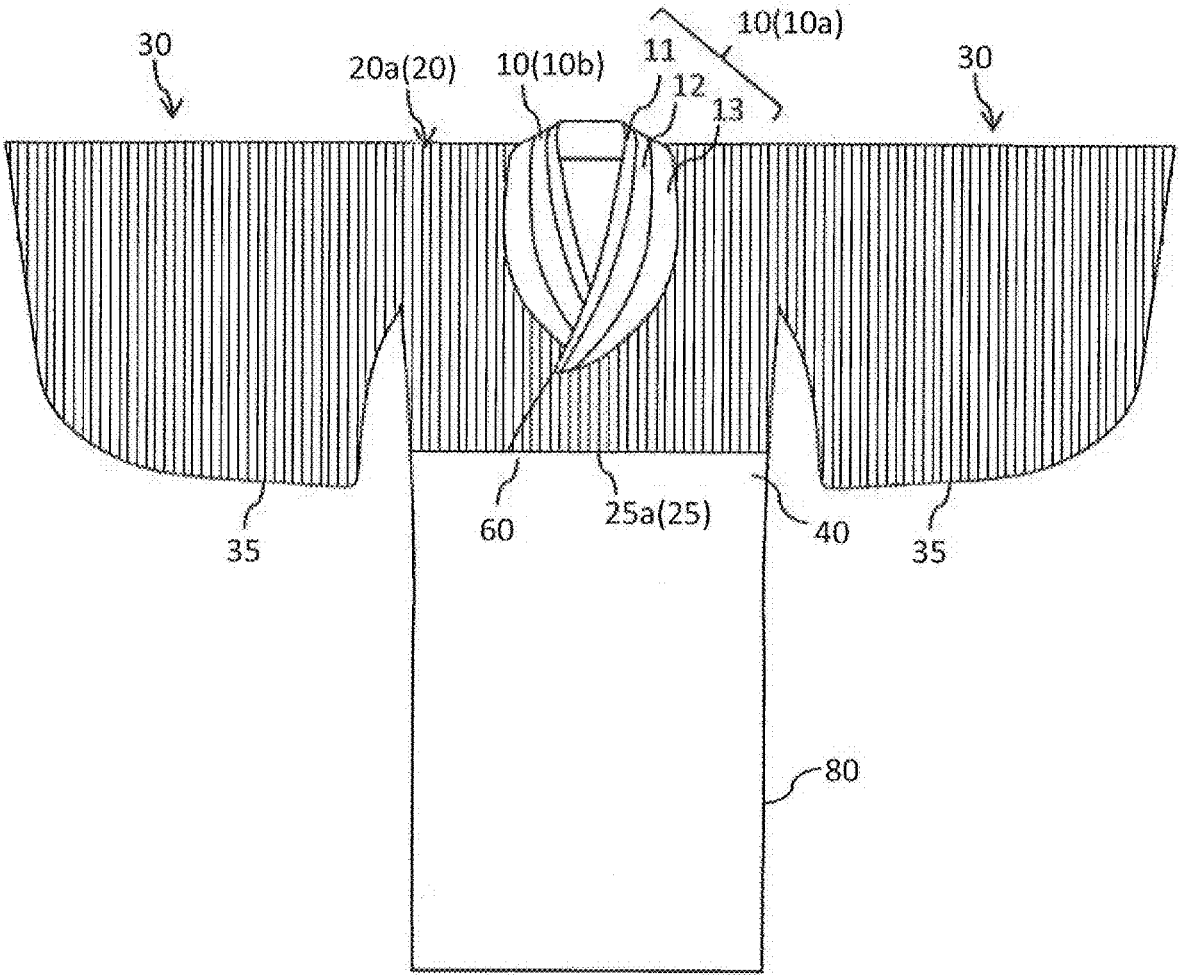
FIG. 12 is a front view illustrating an upper wear side of a garment according to Variation 3 that can be used in an embodiment of the present invention.

As illustrated in FIGS. 3, 11 and 12, one of the collar parts 10 may be fixed to cross the other. In one example, in a position in which one collar part 10*a* crosses the other collar part 10*b*, the end of the one collar part 10*a* and the end of the other collar part 10*b* may be sewn on the waistline part 40 of the main body part 20. In addition, in a position in which the one collar part 10*a* crosses the other collar part 10*b*, the end of the one collar part 10*a* may be sewn on the end of the other collar part 10*b*. The portion thus sewn becomes a coupling part 60. The means (coupling part 60) in which the one collar part 10*a* crosses and is fixed to the other collar part 10*b* may not be made by sewing, but may be of a button type. However, the aspect of sewing is favorable in terms of convenience of wearing and ease of handling.

As illustrated in FIG. 1, the number of coupling parts 60 for fixing one of the collar parts 10 to the other may be just one, but is not limited to such an aspect. As illustrated in FIG. 3, the number of coupling parts 60 may be two or more so that the coupling parts 60 have a first coupling part 61 and a second coupling part 62. The first coupling part 61 may couple the one collar part 10*a* to the waistline part 40 of the main body part 20 on the other side (left side of FIG. 3), and the second coupling part 62 may couple the other collar part 10*b* to the waistline part 40 of the main body part 20 on one side (right side of FIG. 3) with respect to the first coupling part 61. In the aspect illustrated in FIG. 3, the other collar part 10*b* is configured to be set behind the one collar part 10*a*.

In the aspect of a one-piece such as that illustrated in FIG. 3, the coupling parts 60 may be provided at the waistline part 40, and a slit 70 may be formed below the coupling parts 60.

As illustrated in FIGS. 1 and 2, in the case of a two-piece, the upper wear may have an upper wear main body 20*a* having the pair of collar parts 10, and two swinging sleeve parts 30 coupled to the upper wear main body 20*a*. In the case of a two-piece, the main body part 20 has the upper wear main body 20*a* and a lower wear main body 20*b*, which is included in the lower wear.

Figure 4:
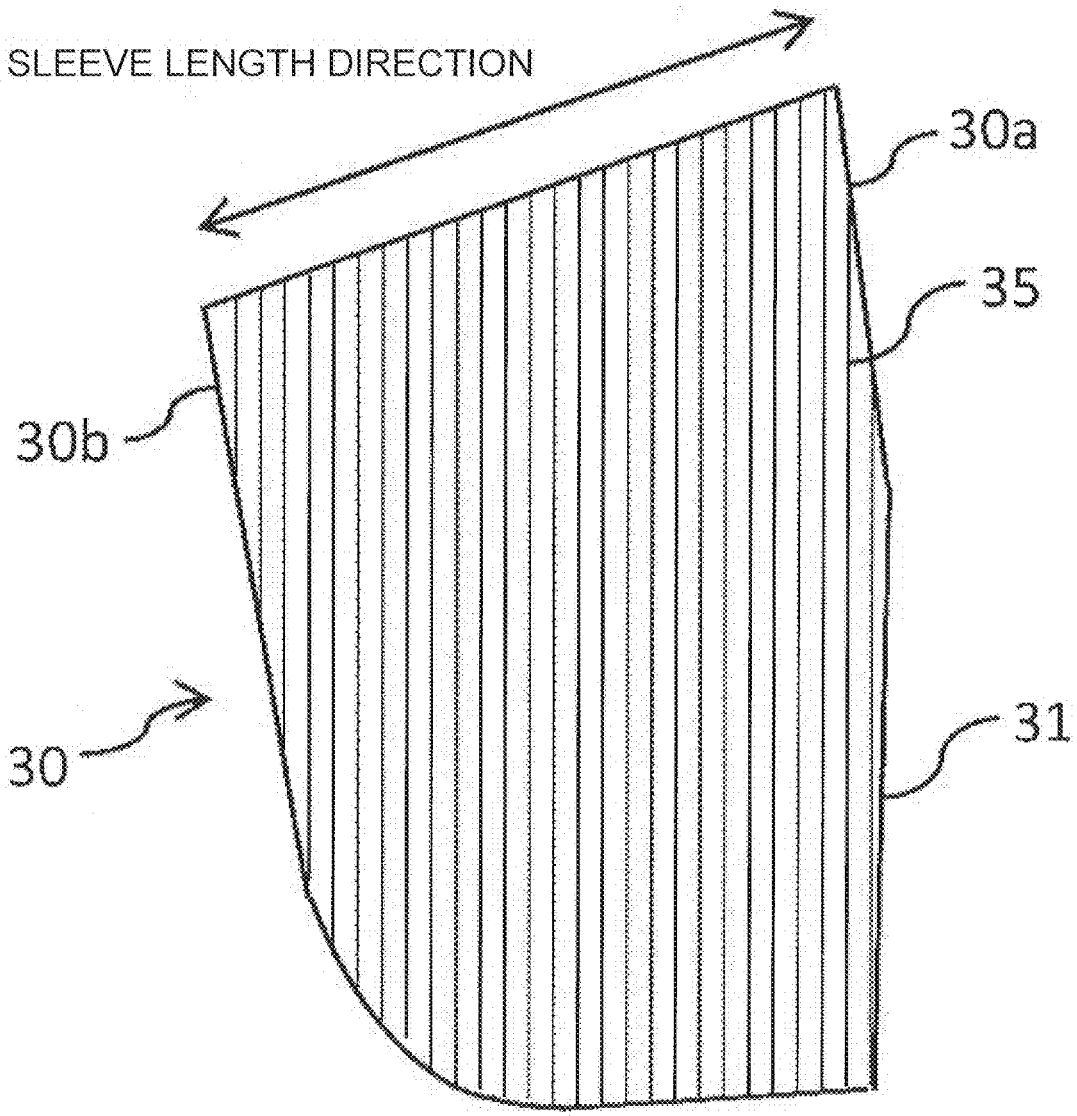
FIG. 4 is a front view illustrating a swinging sleeve part of a garment used in an embodiment of the present invention.

As illustrated in FIG. 4, the swinging sleeve part 30 may have a plurality of swinging sleeve convex-concave parts 35 extending in a direction perpendicular to a direction (sleeve length direction) from a root 30*a* to a sleeve opening 30*b*. The plurality of swinging sleeve convex-concave parts 35 may be extended parallel to one another (see also FIGS. 11 and 12).

In the present embodiment, the phrase "direction from the root 30*a* to the sleeve opening 30*b*" of the swinging sleeve part 30 indicates the direction from the root 30*a* to the sleeve opening 30*b* of the swinging sleeve part 30 obtained when the swinging sleeve part 30 is spread out as illustrated in FIG. 1. Therefore, the direction perpendicular to the extension direction of the swinging sleeve part 30 (right-and-left direction of FIG. 1) is the "up-and-down direction". In addition, the phrase "extending in a direction perpendicular to a direction from the root 30*a* to the sleeve opening 30*b*" includes not only an aspect of extension exactly perpendicular to the direction from the root to the sleeve opening obtained when the swinging sleeve part 30 is spread out, but also an aspect of extension in a state of being inclined relative to the direction from the root to the sleeve opening. In the present embodiment, the wording "extending in direction A" includes not only an aspect of "extending exactly in line with direction A", but also an aspect of "extending by being inclined relative to direction A".

In the aspect of a two-piece, the upper wear main body 20*a* may have a plurality of upper wear convex-concave parts 25*a* extending in the up-and-down direction (see FIGS. 1, 11 and 12). The lower wear main body 20*b* may also have a plurality of lower wear convex-concave parts 25*b* extending in the up-and-down direction (see FIG. 2). In the aspect of a one-piece, the main body part 20 may generally have main body convex-concave parts 25 extending in the up-and-down direction (see FIG. 3). The "up-and-down direction" in the present embodiment indicates an up-and-down direction obtained when the wearer wearing the garment stands up.

Figure 5:
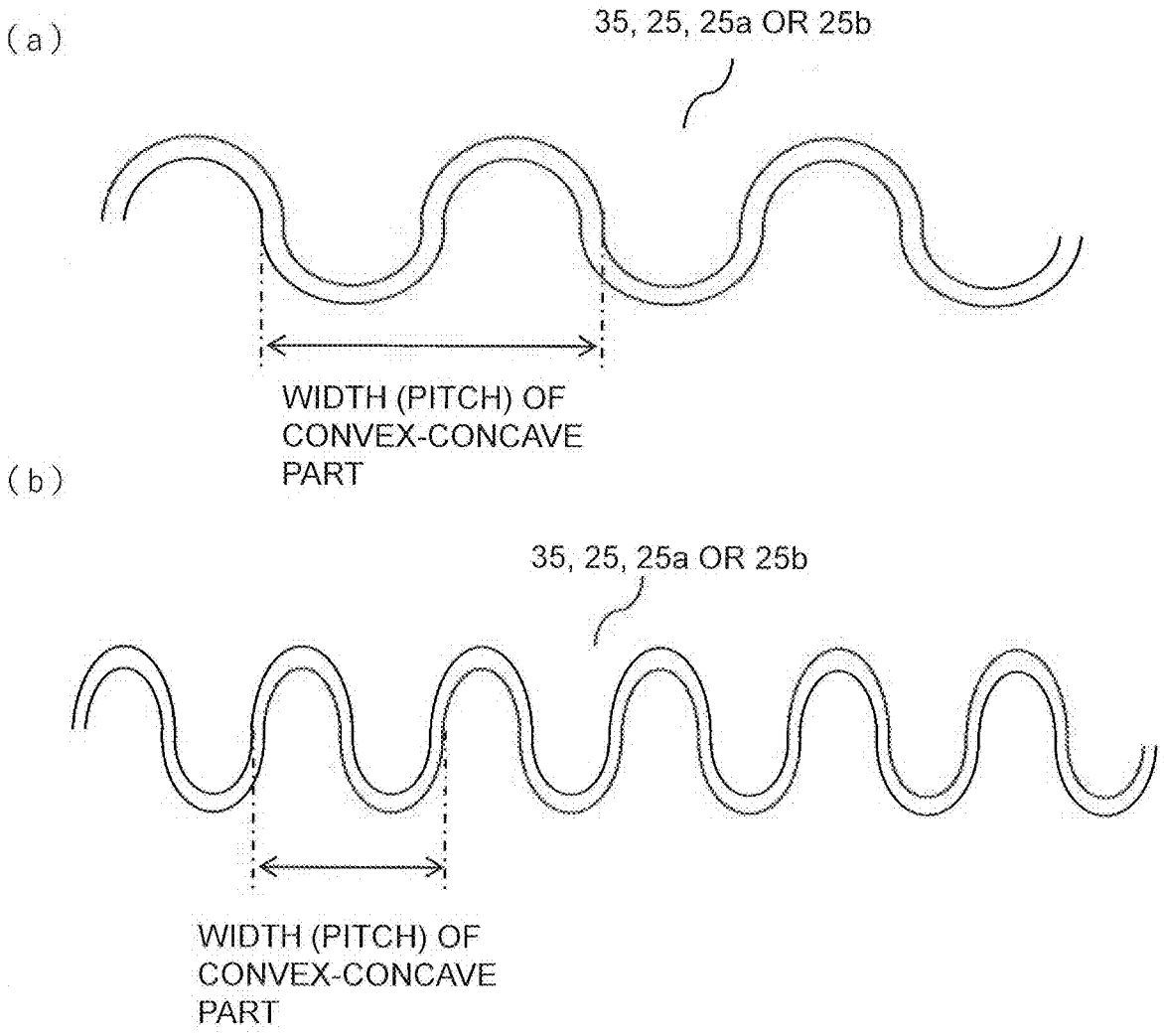
FIG. 5 (*a*) is a cross-sectional view illustrating convex-concave parts used in an embodiment of the present invention, and FIG. 5 (*b*) s a cross-sectional view illustrating convex-concave parts having a width (pitch) narrower than that of FIG. 5(*a*).

FIGS. 5(*a*) and 5(*b*) indicate an example of the cross-section of the shape of the swinging sleeve convex-concave parts 35, the upper wear convex-concave parts 25*a*, the lower wear convex-concave parts 25*b*, and the main body convex-concave parts 25. The cross-section of the swinging sleeve convex-concave parts 35, the upper wear convex-concave parts 25*a*, the lower wear convex-concave parts 25*b*, and the main body convex-concave parts 25 may be pleated to have a wave shape as illustrated in FIGS. 5(*a*) and 5(*b*). FIG. 5(*b*) is a view illustrating an aspect in which the width (pitch) is narrower than that of FIG. 5 (*a*). It is favorable to adopt such pleat because the shape of the swinging sleeve parts 30 can be maintained by a simple manufacturing method.

The numbers of the swinging sleeve convex-concave parts 35, the upper wear convex-concave parts 25*a*, the lower wear convex-concave parts 25*b*, and the main body convex-concave parts 25 can be changed properly. In particular, regarding the swinging sleeve convex-concave parts 35, adjustment of its number enables maintenance of the shape of the swinging sleeve parts 30. In one example, three to eight swinging sleeve convex-concave parts 35 may be provided per centimeter. From the viewpoint of maintaining the shape of the swinging sleeve parts 30, an aspect in which four or more swinging sleeve convex-concave parts 35 are provided per centimeter is favorable.

The width (pitch) of the swinging sleeve convex-concave parts 35, the upper wear convex-concave parts 25*a*, the lower wear convex-concave parts 25*b*, and the main body convex-concave parts 25 may be substantially the same or different. In one example, the width of the swinging sleeve convex-concave parts 35 is substantially the same as the width of the upper wear convex-concave parts 25*a*. However, the widths of the swinging sleeve convex-concave parts 35 and the upper wear convex-concave parts 25*a* may be different from the width of the lower wear convex-concave parts 25*b*. The phrase "the width is substantially the same" in the present embodiment indicates that the average value of the width of one convex-concave part is ±10% of the average value of the width of another convex-concave part. For example, the phrase the width of the swinging sleeve convex-concave parts 35 is substantially the same as the width of the upper wear convex-concave parts 25*a* indicates that an average value W1 of the width of the swinging sleeve convex-concave parts 35 and an average value W2 of the width of the upper wear convex-concave parts 25*a* are as follows: $W2\times0.9\leq W1\leq W2\times1.1$.

FIGS. 11 and 12 indicate an aspect in which the widths (pitches) of the swinging sleeve convex-concave parts 35 and the upper wear convex-concave parts 25*a* are substantially the same. In FIG. 11, the upper wear convex-concave parts 25*a* are also provided in the inner surface of the garment, but are not limited thereto. As illustrated in FIG. 12, the upper wear convex-concave parts 25*a* may be provided only in the outer surface of the garment and the upper wear convex-concave parts 25*a* may not be provided in the inner surface of the garment. Similarly, regarding the swinging sleeve convex-concave parts 35, the lower wear convex-concave parts 25*b*, and the main body convex-concave parts 25, the swinging sleeve convex-concave parts 35, the lower wear convex-concave parts 25*b*, and/or the main body convex-concave parts 25 may be provided only in the outer surface of the garment and these may not be provided in the inner surface of the garment.

As illustrated in FIGS. 1, 11 and 12, the collar part 10 may have a first collar fabric 11, a second collar fabric 12 provided on the first collar fabric 11, and a third collar fabric 13 provided on the second collar fabric 12. The first collar fabric 11, the second collar fabric 12, and the third collar fabric 13 may not be provided with a convex-concave part. However, as illustrated in FIG. 3, the collar part 10 may be provided with collar convex-concave parts 15.

The first collar fabric 11, the second collar fabric 12, and the third collar fabric 13 may be formed in different colors. For example, the first collar fabric 11 may be in yellow color, the second collar fabric 12 may be in red color, and the third collar fabric 13 may be in green color. The first collar fabric 11, the second collar fabric 12, and the third collar fabric 13 are of different sizes and may be as follows: the area of the first collar fabric 11>the area of the second collar fabric 12>the area of the third collar fabric 13. In this aspect, as illustrated in FIG. 1, the second collar fabric 12 may lie out of the inner circumferential edge of the third collar fabric 13, and the first collar fabric 11 may lie out of the inner circumferential edge of the second collar fabric 12, so that the first collar fabric 11, the second collar fabric 12, and the third collar fabric 13 can be viewed. The outer circumferential edges of the first collar fabric 11, the second collar fabric 12, and the third collar fabric 13 may be sewn by the same sewing thread.

In the aspect of a two piece, as illustrated in FIG. 1, a lower wear back fabric 80 for preventing the lower wear main body 20*b* from showing through may be provided at a lower end of the upper wear. The lower wear back fabric 80 may not be provided with convex-concave parts. The main material of the lower wear back fabric 80 may also be polyester.

Figure 6:
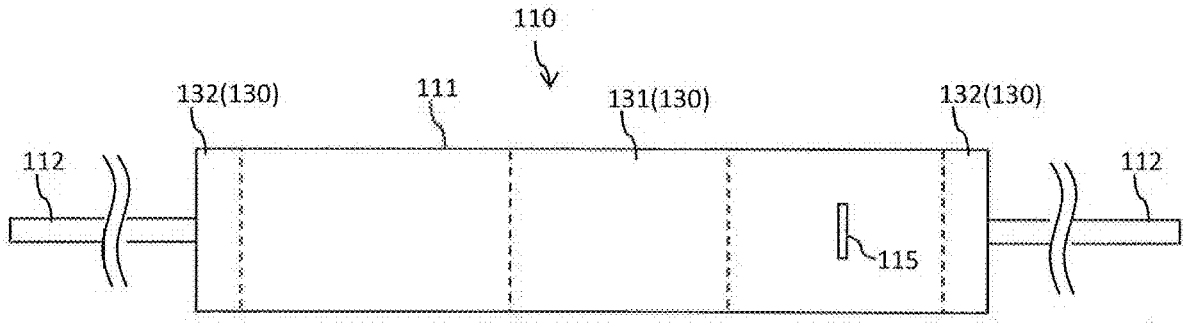
FIG. 6 is a development view of an obi strap part used in an embodiment of the present invention.
Figure 7:
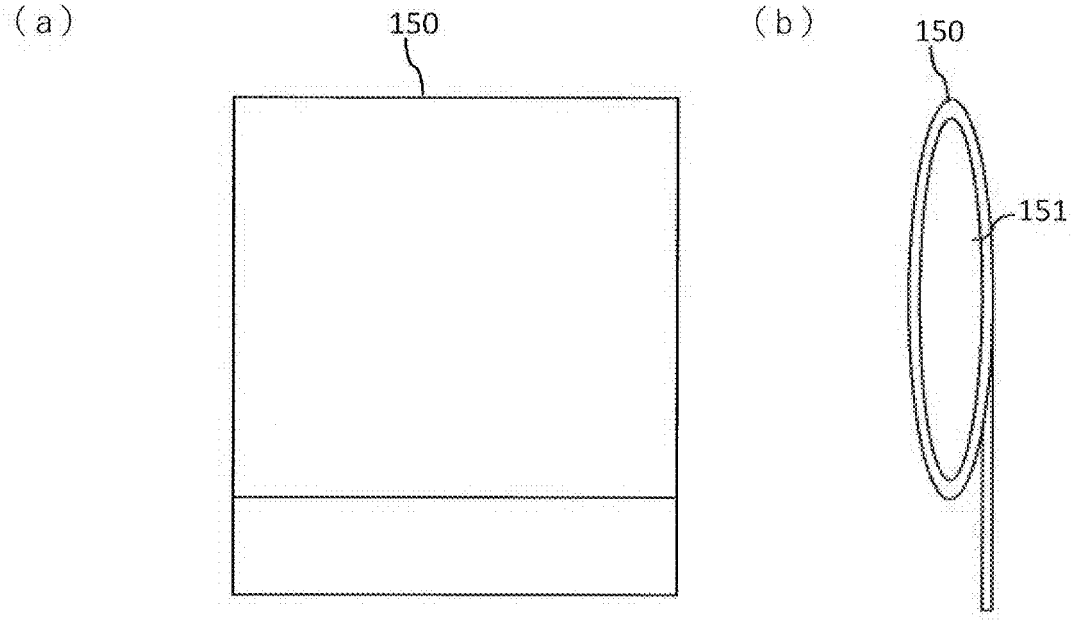
FIG. 7 (*a*) is a rear view illustrating an obi tying part used in an embodiment of the present invention, and FIG. 7 (*b*) is a side view illustrating the obi tying part illustrated in FIG. 7 (*a*).
Figure 8:
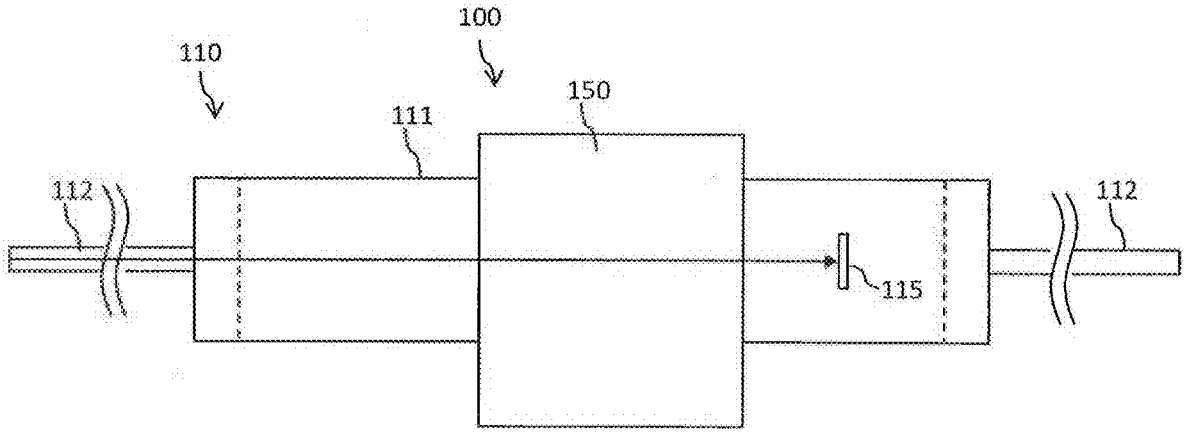
FIG. 8 is a view illustrating an aspect in which an obi tying part is combined with an obi strap part used in an embodiment of the present invention.

As illustrated in FIG. 8, the obi part 100 may have an obi strap part 110 and an obi tying part 150, which is a separate body from the obi strap part 110. As illustrated in FIG. 6, the obi strap part 110 may have a first obi strap part 111 and a pair of second obi strap parts 112, which are smaller in width than the first obi strap part 111 and extended from the first obi strap part 111. As illustrated in FIG. 7, the obi tying part 150 may have a tying opening part 151. The first obi strap part 111 may be positioned in the tying opening part 151, so that the first obi strap part 111 can be covered by the obi tying part 150 (see FIG. 8).

As illustrated in FIG. 6, the first obi strap part 111 may be provided therein with a thick paper part 130 (e.g., a cardboard-like thick paper). In one example, a first thick paper part 131 may be provided at a portion to be covered by the obi tying part 150, and a second thick paper part 132 may be provided at both ends of the first obi strap part 111. The width of the first thick paper part 131 in the right-and-left direction (right-and-left direction of FIG. 6) may be larger than the width of the second thick paper part 132 in the right-and-left direction. The width of the first thick paper part 131 in the right-and-left direction may be larger than the width of the obi tying part 150 in the right-and-left direction. The width of the first thick paper part 131 in the right-and-left direction may be substantially the same as the width of the obi tying part 150 in the right-and-left direction. However, the present invention is not limited thereto, but the width of the first thick paper part 131 in the right-and-left direction may be smaller than the width of the obi tying part 150 in the right-and-left direction.

Figure 9:
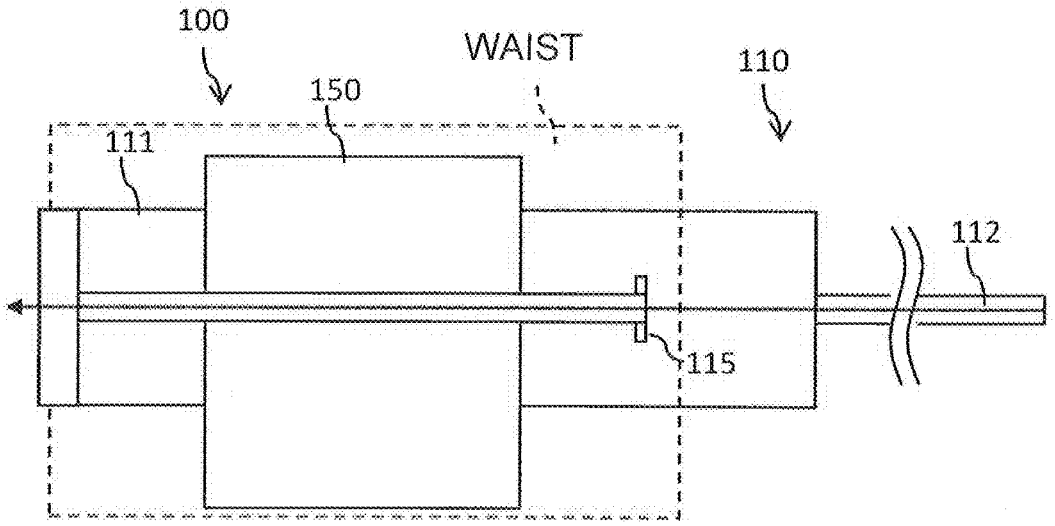
FIG. 9 is a view illustrating an aspect in which a second obi strap part on the left side in the state of FIG. 8 is placed through a passage hole and is wound around the waist of a wearer.

The first obi strap part 111 may be formed with a passage hole 115 through which one of the pair of second obi strap parts 112 is placed. In the aspect illustrated in FIG. 6, the passage hole 115 is formed on the right side of the portion at which the first thick paper part 131 is provided. The second obi strap part 112 on the left side of FIG. 6 can be placed through the passage hole 115 (see FIG. 9). The passage hole 115 may have its central position at the central position of the first obi strap part 111 in the up-and-down direction. As illustrated in FIG. 10, the first obi strap part 111 can be wound around the trunk. The knot of the pair of first obi strap parts 111 can also be positioned in the tying opening part 151 of the obi tying part 150.

Operations and Effects

Next, a description is given with a focus on operations and effects of the present embodiment made of the aforementioned configuration, which have not been described. Every feature described in "Operations and Effects" can be used as a feature of the present embodiment.

As illustrated in FIGS. 1 and 3, when the aspect that has the swinging sleeve parts 30 and the obi part 100 and in which one of the collar parts 10 is fixed to the other is adopted, the garment looks like Japanese clothing (see also FIG. 13) and enables easy wearing of the garment.

In addition, as illustrated in FIGS. 4, 11 and 12, when the aspect in which the swinging sleeve parts 30 have the plurality of swinging sleeve convex-concave parts 35 extending in the direction perpendicular to the direction from the root to the sleeve opening is adopted, the shape of the swinging sleeve parts 30 can easily be maintained and can give a Japanese clothing-like impression. Specifically, when the swinging sleeve parts 30 do not have the plurality of swinging sleeve convex-concave parts 35, the swinging sleeve parts 30 are so flexible that the shape easily deforms. In contrast, when the aspect in which the swinging sleeve parts 30 have the plurality of swinging sleeve convex-concave parts 35 extending in the up-and-down direction is adopted, the shape of the swinging sleeve parts 30 can be maintained (even without having to use a wire or the like) to easily achieve large swinging sleeve parts 30, eventually achieving high designability. From the viewpoint of maintaining such a shape, it is favorable that the plurality of swinging sleeve convex-concave parts 35 extend parallel to one another. In addition, it is favorable to provide the swinging sleeve convex-concave parts 35 because stretchability can be obtained and the formation of wrinkles can be prevented.

In addition, it is very favorable to use polyester as the main material with regard to the material of the swinging sleeve parts 30 because polyester has the characteristic of being inexpensive and lightweight and the shape of the swinging sleeve parts 30 does not easily deform. In addition, it is favorable to use polyester as the main material because polyester can also achieve the non-sticky characteristic.

As illustrated in FIGS. 1, 3 and 4, it is favorable to adopt the aspect in which the ends (inner circumferential ends) of the pair of swinging sleeve parts 30 facing the main body part 20 have the straight extension part 31 because the swinging sleeve convex-concave parts 35 can be provided over a long distance at the ends of the inner circumferential side to make the shape of the swinging sleeve parts 30 even less deformable.

When the aspect in which the end of the one collar part 10*a* and the end of the other collar part 10*b* are sewn on the waistline part 40 of the main body part 20 is adopted, a plunging neckline can be obtained to achieve high designability (see FIGS. 1, 11 and 12).

As illustrated in FIGS. 1 and 3, it is favorable to adopt the aspect in which the end of each of the pair of swinging sleeve parts 30 facing the main body part 20 is provided with the swinging sleeve opening part 39 because the functionality can be increased. In addition, similarly, it is favorable to adopt the aspect in which each end of the main body part 20 facing the swinging sleeve parts 30 is provided with the main body opening part 29 because the functionality can be increased.

As illustrated in FIG. 3, in the aspect of a two-piece, it is favorable to adopt the aspect in which the coupling part 60 is provided at the waistline part 40 and the slit 70 is formed below the waistline part 40 because the functionality can be increased and the designability can be increased.

As illustrated in FIG. 3, it is favorable to adopt the aspect of having the first coupling part 61 for coupling the one collar part 10*a* to the waistline part 40 of the main body part 20 and the second coupling part 62 for coupling the other collar part 10*b* to the waistline part 40 of the main body part 20 on one side (right side of FIG. 3) relative to the first coupling part 61 because the collar parts 10 can cross more three-dimensionally.

In the aspect of a two-piece, it is favorable to provide the plurality of upper wear convex-concave parts 25*a* and/or the plurality of lower wear convex-concave parts 25*b* extending in the up-and-down direction because the formation of wrinkles or the like can be prevented with regard to the upper wear and/or the lower wear. In addition, in the aspect of a one-piece, it is favorable to provide the plurality of main body convex-concave parts 25 extending in the up-and-down direction because the formation of wrinkles or the like on the main body part 20 can be prevented.

It is favorable to adopt the aspect in which the width (pitch) of the swinging sleeve convex-concave parts 35, the upper wear convex-concave parts 25*a* and/or the lower wear convex-concave parts 25*b*, or the main body convex-concave parts 25 is substantially the same because it is possible to give a similar appearance impression (see FIGS. 11 and 12).

In contrast, when the width (pitch) of the swinging sleeve convex-concave parts 35, the upper wear convex-concave parts 25*a* and/or the lower wear convex-concave parts 25*b*, or the main body convex-concave parts 25 varies, it is possible to give a different impression. The swinging sleeve convex-concave parts 35 are rather intended for maintenance of the shape of the swinging sleeve parts 30. Therefore, the width of the swinging sleeve convex-concave parts 35 may be reduced to be smaller than the width of the convex-concave parts provided in the main body part 20 (including the upper wear main body 20*a* and the lower wear main body 20*b* in the aspect of a two-piece). From the viewpoint of maintaining the shape of the swinging sleeve parts 30, for example, four or more swinging sleeve convex-concave parts 35 may be provided per centimeter. However, examples of elements for maintaining the shape of the swinging sleeve parts 30 can include the thickness, the material, or the like of fabric. The width of the swinging sleeve convex-concave parts 35 may be adjusted property in consideration of the above.

As illustrated in FIG. 1, when the aspect in which the collar part 10 has the first collar fabric 11, the second collar fabric 12 provided on the first collar fabric 11, and the third collar fabric 13 provided on the second collar fabric 12 is adopted, it is possible to achieve high designability because a plunging neckline can be obtained to drawn stares to the neckline.

It is favorable to adopt the aspect in which the main body part 20 (including the upper wear main body 20*a* and the lower wear main body 20*b* in the aspect of a two-piece) is provided with convex-concave parts and the first collar fabric 11, the second collar fabric 12 and the third collar fabric 13 are provided with no convex-concave parts because it is possible to give different impressions between the main body part 20 and the collar part 10. From this viewpoint, it is favorable that the first collar fabric 11, the second collar fabric 12, and the third collar fabric 13 be formed in different colors. In addition, as illustrated in FIGS. 1, 11 and 12, it is also favorable that the second collar fabric 12 lie out of the inner circumferential edge of the third collar fabric 13 and the first collar fabric 11 lie out of the inner circumferential edge of the second collar fabric 12, so that the first collar fabric 11, the second collar fabric 12, and the third collar fabric 13 can be viewed. Considering ease of manufacturing, it is favorable that the outer circumferential edges of the first collar fabric 11, the second collar fabric 12, and the third collar fabric 13 be sewn by the same sewing thread.

As illustrated in FIGS. 6 to 10, it is favorable to adopt the aspect in which the obi part 100 has the obi strap part 110 and the obi tying part 150, which is a separate body from the obi strap part 110, because the garment according to the present embodiment can be worn easily.

As illustrated in FIG. 6, it is favorable to adopt the aspect in which the obi strap part 110 has the first obi strap part 111 and the pair of second obi strap parts 112 having the width smaller than that of the first obi strap part 111 and extending from the first obi strap part 111 because the Japanese clothing obi-like appearance can be achieved by the first obi strap part 111 and the pair of second obi strap parts 112 are tied to wind and fix the obi strap part 110 around the trunk part to eliminate the need of dressing unlike Japanese clothing. According to the present embodiment, the second obi strap parts 112 are tied in the tying opening part 151 on the front side of the wearer, and then the knot, the obi strap part 110 and the obi tying part 150 are turned to the back side, thereby easily enabling Japanese clothing-like attire (see FIG. 13). In addition, when the knot of the second obi strap parts 112 is positioned in the tying opening part 151, the knot of the second obi strap parts 112 can be less obvious to enhance the appearance.

As illustrated in FIG. 6, it is favorable to provide the first thick paper part 131 in the first obi strap part 111 at a portion to be covered by the obi tying part 150 because the strength of the portion corresponding to the obi tying part 150 can be increased inexpensively.

In addition, it is favorable to provide the second thick paper part 132 in the first obi strap part 111 at both ends of the first obi strap part 111 because the general shape of the first obi strap part 111 can be retained in combination with the first thick paper part 131.

It is favorable to adopt the aspect in which the first obi strap part 111 is provided with the passage hole 115 through which one of the pair of second obi strap parts 112 is placed because the second obi strap parts 112 can be tied while the second obi strap parts 112 are positioned in a preferable position (particularly, in a position of the up-and-down direction) with respect to the first obi strap part 111. In particular, it is favorable to adopt the aspect in which the central position of the passage hole 115 in the up-and-down direction is positioned at the central position of the first obi strap part 111 in the up-and-down direction because the second obi strap parts 112 can be positioned at the central position of the first obi strap part 111 in the up-and-down direction. In addition, from this viewpoint, it is favorable that the widths of the second obi strap parts 112 and the passage hole 115 in the up-and-down direction be designed so as not to form a substantive gap in the up-and-down direction when the second obi strap part 112 is placed through the passage hole 115.

Figure 14:
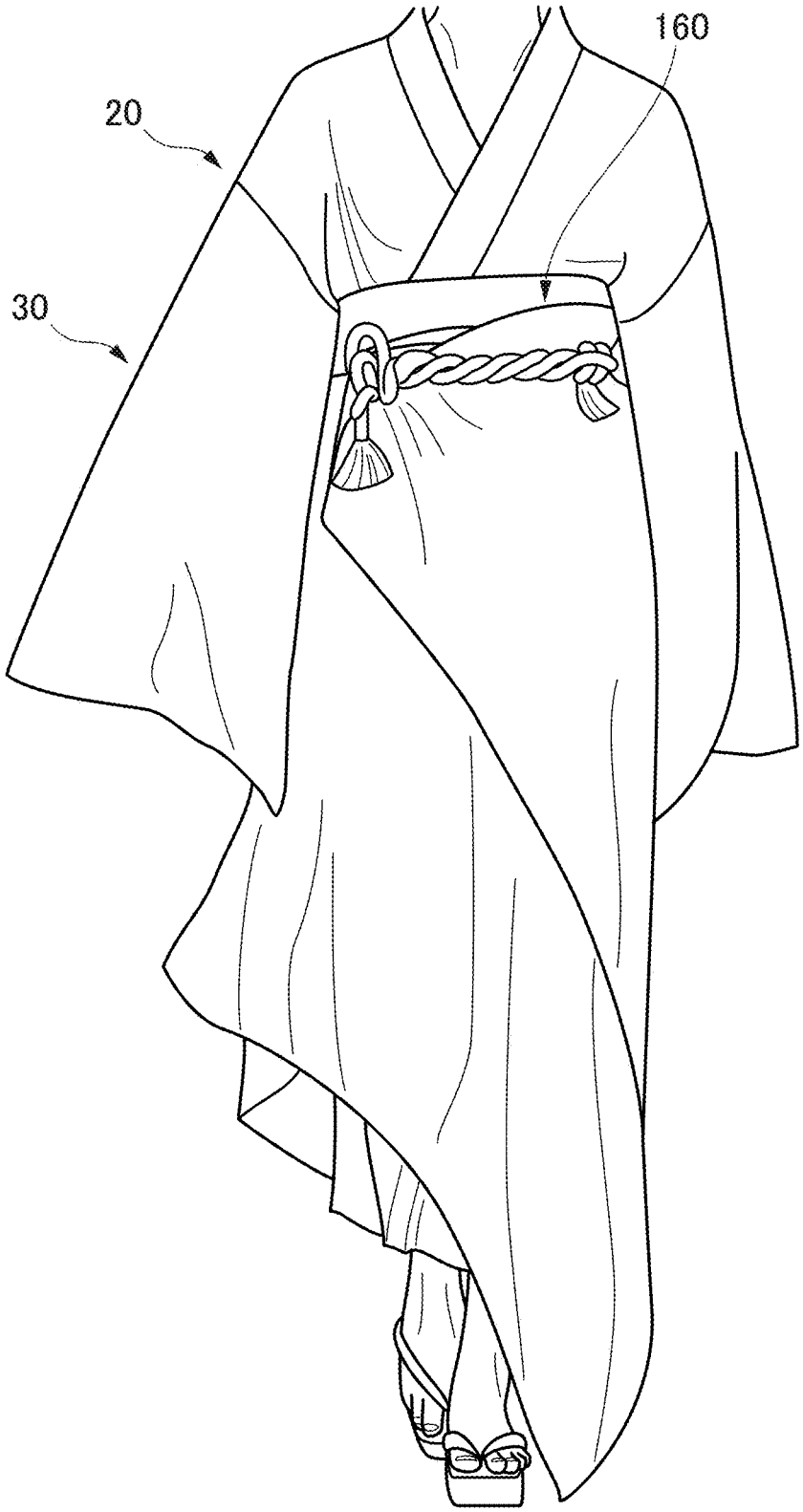
FIG. 14 is another photograph illustrating a state in which a garment that can be used in an embodiment of the present invention is worn.
Figure 15:
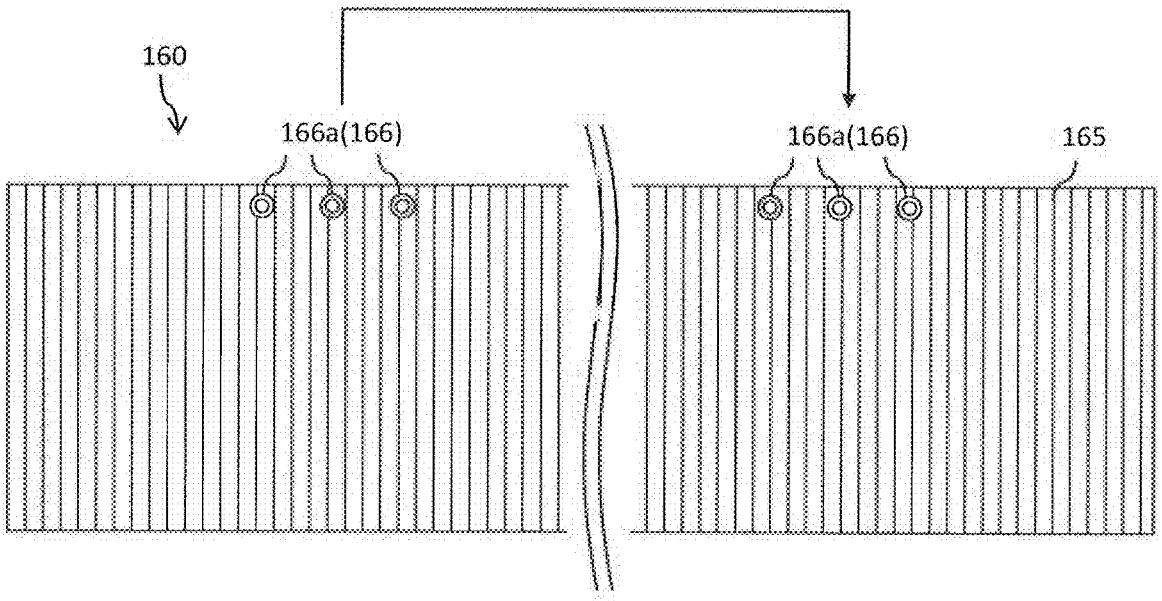
FIG. 15 is a development view of a belly band part that can be used in an embodiment of the present invention.

As illustrated in FIG. 14, a belly band part 160 wound on the outside of the main body part 20 may be provided. The belly band part 160 may have a plurality of belly band convex-concave parts 165 extending in a direction perpendicular to a winding direction, (right-and-left direction of FIG. 15). The belly band convex-concave parts 165 may also be pleated to have a wave shape. In addition, polyester may also be used as the main material of the belly band part 160.

The belly band part 160 may have an attachment part 166 at the end (upper end of FIG. 15) positioned on the waist side. The attachment part 166 may have a plurality of (three in FIG. 15) button parts **166*a* or a plurality of hook parts. Providing the plurality of button parts 166*a* or the plurality of hook parts enables attachment at a plurality of positions, enabling adjustment of the position of the belly band part 160 to the size corresponding to the waist of the wearer. In the aspect illustrated in FIG. 15, three male-type button parts 166*a* are provided on the left side and three female-type button parts 166*a*** are provided on the right side.

When the aspect of having the plurality of belly band convex-concave parts 165 is adopted, the shape can be maintained to a certain extent. Therefore, the tuck having a wave shape can be maintained. Even when the wearer moves, the wave shape can be maintained. In addition, because a certain shape can be maintained, it is possible to prevent the belly band part 160 from drooping by gravity. It is also possible to expect that a bonding effect that enables maintenance of a certain shape without the use of a wire or the like is obtained.

The description of the aforementioned embodiment and the disclosure of the drawings are a mere example for describing the invention stated in the claims, and the invention stated in the claims is not limited to the description of the aforementioned embodiment or the disclosure of the drawings. The statement of the claims of the application as originally filed can be changed properly within the scope of the present patent description, and its scope can also be extended.

REFERENCE SIGNS LIST

10 collar part
11 first collar fabric
12 second collar fabric
13 third collar fabric
20 main body part
25 main body convex-concave part
30 swinging sleeve part
40 waistline part
100 obi part
110 obi strap part
115 passage hole
111 first obi strap part
112 second obi strap part
130 thick paper part
131 first thick paper part
132 second thick paper part
150 obi tying part

What is claimed is:

1. A garment comprising:

a main body part having a pair of collar parts and a waistline part positioned below the collar parts;

two swinging sleeve parts coupled to the main body part; and an obi part wound around the waistline part;

wherein one of the pair of collar parts is fixed to another one of the pair of collar parts; and the two swinging sleeve parts have a plurality of swinging sleeve convex-concave parts extending in a direction perpendicular to a direction from a root to a sleeve opening and having convex-concave shapes in a cross-sectional view to maintain a shape of the swinging sleeve parts.

2. The garment according to claim 1, wherein the main body part has a plurality of main body convex-concave parts.

3. The garment according to claim 1, wherein the collar part has a first collar fabric, a second collar fabric provided on the first collar fabric, and a third collar fabric provided on the second collar fabric, and the first collar fabric, the second collar fabric and the third collar fabric are not provided with a convex-concave part.

4. The garment according to claim 1, wherein the obi part has an obi strap part, which includes a first obi strap part and a pair of second obi strap parts extended from the first obi strap part, and an obi tying part, which is a separate body from the obi strap part and covers the first obi strap part, and a passage hole, through which the second obi strap part is placed, is formed in the first obi strap part.

5. The garment, according to claim 1, further comprising a belly band part, which has a plurality of belly band convex-concave parts and is wound around the main body part.

6. A garment comprising:

a main body part having a pair of collar parts and a waistline part positioned below the collar parts;

two swinging sleeve parts coupled to the main body part and an obi part wound around the waistline part, wherein one of the pair of collar parts is fixed to another one of the pair of collar parts and the two swinging sleeve parts have a plurality of swinging sleeve convex-concave parts extending in a direction perpendicular to a direction from a root to a sleeve opening, wherein the obi part has an obi strap part, which includes a first obi strap part and a pair of second obi strap parts extended from the first obi strap part, and an obi tying part, which is a separate body from the obi strap part and which covers the first obi strap part, and a passage hole, through which the second obi strap part is placed, is formed in the first obi strap part, the garment further comprising a thick paper part provided in the first obi strap part, wherein the thick paper part has a first thick paper part provided at a portion to be covered by the obi tying part, and a second thick paper part provided at both ends of the first obi strap part.

* * * * *